US008406664B2

(12) United States Patent
Fujita et al.

(10) Patent No.: US 8,406,664 B2
(45) Date of Patent: Mar. 26, 2013

(54) IMAGE FORMING APPARATUS, IMAGE FORMING METHOD, AND DEVELOPING DEVICE

(75) Inventors: Tetsumaru Fujita, Hyogo (JP); Yuji Nagatomo, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 843 days.

(21) Appl. No.: 12/204,083

(22) Filed: Sep. 4, 2008

(65) Prior Publication Data

US 2009/0067887 A1 Mar. 12, 2009

(30) Foreign Application Priority Data

Sep. 12, 2007 (JP) ..... 2007-236438

(51) Int. Cl.
*G03G 15/01* (2006.01)

(52) U.S. Cl. ..... 399/302; 399/149; 399/150

(58) Field of Classification Search ..... 399/223, 399/149, 150

See application file for complete search history.

(56) References Cited

U.S. PATENT DOCUMENTS

| | | | | |
|---|---|---|---|---|
| 5,797,070 | A * | 8/1998 | Waki et al. | 399/149 |
| 7,684,732 | B2 | 3/2010 | Fujita et al. | |
| 7,907,871 | B2 | 3/2011 | Sakagawa et al. | |
| 2005/0271416 | A1* | 12/2005 | Kinoshita et al. | 399/129 |
| 2007/0059034 | A1 | 3/2007 | Fujita | |
| 2007/0065179 | A1 | 3/2007 | Fujita | |
| 2007/0172259 | A1 | 7/2007 | Fujita | |
| 2007/0280735 | A1 | 12/2007 | Nagatomo et al. | |
| 2008/0038017 | A1 | 2/2008 | Fujita et al. | |
| 2008/0056745 | A1 | 3/2008 | Fujita et al. | |
| 2008/0069592 | A1 | 3/2008 | Fujita et al. | |
| 2008/0145100 | A1 | 6/2008 | Sakagawa et al. | |
| 2008/0145109 | A1 | 6/2008 | Murayama et al. | |
| 2008/0152384 | A1 | 6/2008 | Fujita et al. | |
| 2008/0152385 | A1 | 6/2008 | Fujita et al. | |
| 2008/0181654 | A1 | 7/2008 | Sakagawa et al. | |
| 2008/0181655 | A1 | 7/2008 | Sakagawa et al. | |
| 2008/0187360 | A1 | 8/2008 | Fujita et al. | |
| 2008/0187361 | A1 | 8/2008 | Sakagawa et al. | |
| 2008/0273898 | A1 | 11/2008 | Sakagawa et al. | |

FOREIGN PATENT DOCUMENTS

| | | |
|---|---|---|
| JP | 02-285374 | 11/1990 |
| JP | 04-268587 | 9/1992 |
| JP | 2003-302834 | 10/2003 |
| JP | 3597254 | 9/2004 |
| JP | 3728166 | 10/2005 |
| JP | 2006-072119 | * 3/2006 |
| JP | 2008-46172 | 2/2008 |

OTHER PUBLICATIONS

Office Action issued Feb. 24, 2012, in Japanese Application No. 2007-236438, filed Sep. 12, 2007. (without an English translation).

* cited by examiner

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

An image forming apparatus includes a plurality of image carriers, a latent image forming unit, and a plurality of developing units. Each of the developing unit forms an image to have a color difference of equal to or less than about five with respect to an initial unicolor image formed by using a toner not containing a reversely-transferred toner of another color when a toner contained in a toner container is consumed by about 70%.

18 Claims, 2 Drawing Sheets

IMAGE FORMING APPARATUS, IMAGE FORMING METHOD, AND DEVELOPING DEVICE

CROSS-REFERENCE TO RELATED APPLICATIONS

The present application claims priority to and incorporates by reference the entire contents of Japanese priority document 2007-236438 filed in Japan on Sep. 12, 2007.

BACKGROUND OF THE INVENTION

1. Field of the Invention

The present invention relates to an image forming apparatus and a developing device.

2. Description of the Related Art

Tandem-type image forming apparatuses are known in which a latent image is formed on each of a plurality of image carriers, each of the latent images is then developed into unicolor toner image by using a unicolor toner, the unicolor toner images are then sequentially transferred onto a transfer belt in a superimposing manner to obtain a full color image, and the full color image is then printed on a sheet of paper. Residual toner, which is toner that remains on the image carriers after the unicolor toner images are transferred onto the transfer belt, is cleaned by using a cleaner member such as a cleaning blade.

Cleaner-less type image forming apparatuses are known, in which residual toner is temporary captured, returned to the surface of the image carrier after a printing has been completed or at a predetermined timing, and collected by a developing unit. Conventional technologies are disclosed in, for example, Japanese Patent No. 3728166 and Japanese Patent No. 3597254.

However, when a paper sheet with a first unicolor unfixed toner image, say yellow image, thereon reaches to a subsequent image carrier for a subsequent second unicolor unfixed toner image to be transferred thereon, say magenta image, toner of the first unicolor unfixed toner image may be disadvantageously reversely transferred onto the subsequent image carrier. In the cleaner-less tandem-type image forming apparatus, reversely transferred toner of the first unicolor, i.e., yellow, is disadvantageously collected into a developing unit of the second unicolor, i.e., magenta. In the beginning, the proportion of the reversely-transferred yellow toner in the developing unit for magenta is low. However, as the magenta toner is consumed and more and more yellow toner accumulates in the developing unit as time passes, the proportion of the yellow toner in the magenta developing unit increases. As a result, a clear magenta image can not be formed. In other words, color reproducibility degrades over time.

SUMMARY OF THE INVENTION

It is an object of the present invention to at least partially solve the problems in the conventional technology.

According to an aspect of the present invention, there is provided an image forming apparatus that includes a plurality of image carriers each of which carries a unicolor image of a corresponding color; and a developing unit corresponding to each of the image carriers, each of the developing units includes a toner container that contains a first toner; and a developer carrier that picks the first toner from the toner container and carries the first toner to a corresponding image carrier thereby developing a latent image on the corresponding image carrier with the first toner into a unicolor toner image, and collects a second toner remaining on the corresponding image carriers into the developing unit after the toner image has been transferred from the corresponding image carrier onto a transfer target member. The developing unit is configured such that a color difference between a first image and a second image formed on a transfer target member is equal to or less than about five, the first image being an image formed with the first toner not containing any other toner, and the second image being an image formed with a mixture of the first toner and the second toner while the first toner contained in the toner container is consumed by about 70%.

According to another aspect of the present invention, there is provided a developing device for use in an image forming apparatus, the image forming apparatus including an image carrier, the developing unit that includes a toner container that contains a first toner; and a developer carrier that picks the first toner from the toner container and carries the first toner to the image carrier thereby developing a latent image on the image carrier with the first toner into a unicolor toner image, and collects a second toner remaining on the image carriers into the toner container after the toner image has been transferred from the image carrier onto a transfer target member. The developing unit is configured such that a color difference between a first image and a second image formed on a transfer target member is equal to or less than about five, the first image being an image formed with the first toner not containing any other toner, and the second image being an image formed with a mixture of the first toner and the second toner while the first toner contained in the toner container is consumed by about 70%.

According to still another aspect of the present invention, there is provided an image forming method implemented on an image forming apparatus that includes a plurality of image carriers each of which carries a unicolor image of a corresponding color; and a developing unit corresponding to each of the image carriers, each of the developing units includes a toner container that contains a first toner; and a developer carrier that picks the first toner from the toner container and carries the first toner to a corresponding image carrier thereby developing a latent image on the corresponding image carrier with the first toner into a unicolor toner image, and collects a second toner remaining on the corresponding image carriers into the developing unit after the toner image has been transferred from the corresponding image carrier onto a transfer target member. The image forming method includes configuring the developing unit such that a color difference between a first image and a second image formed on a transfer target member is equal to or less than about five, the first image being an image formed with the first toner not containing any other toner, and the second image being an image formed with a mixture of the first toner and the second toner while the first toner contained in the toner container is consumed by about 70%.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
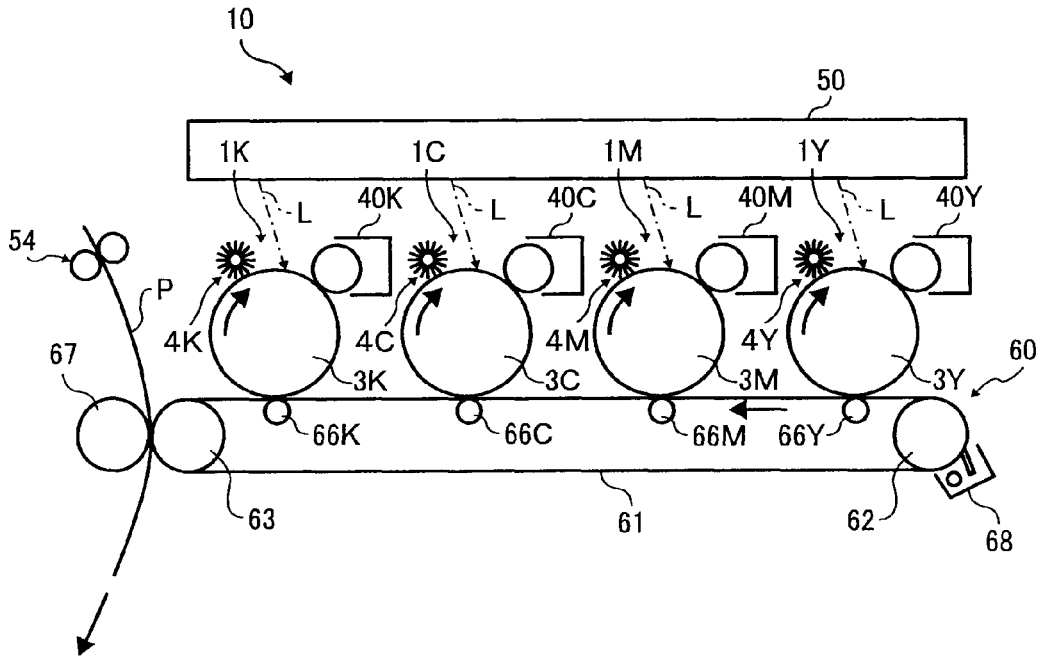
FIG. 1 is a schematic diagram of an image forming apparatus according to an embodiment of the present invention.

Exemplary embodiments of the present invention are explained in detail below with reference to the accompanying drawings. In the following embodiments the present invention has been applied to an image forming apparatus such as an electrophotographic color laser printer. FIG. 1 is a schematic diagram of an image forming apparatus 10 according to an embodiment of the present invention. The image forming apparatus 10 includes four process units 1Y, 1M, 1C, and 1K that form toner images for four colors of yellow (Y), magenta (M), cyan (C), and black (K), an optical write unit 50 that forms latent images, a pair of registration rollers 54, and a transfer unit 60.

The optical write unit 50 includes four light sources of laser diodes corresponding to the four colors, a polygon mirror (regular hexahedron), a polygon motor that drives the polygon mirror to rotate, an fθ lens, a lens, and a reflecting mirror (all are not shown). A laser light L emitted from the laser diode is reflected by one surface of the polygon mirror and is deflected along the rotation of the polygon mirror to reach one of four drum-type photosensitive elements 3Y, 3M, 3C, and 3K of the respective process units 1Y, 1M, 1C, and 1K. Each of the photosensitive elements 3Y, 3M, 3C, and 3K is scanned by the laser light L emitted from the corresponding laser diode.

Each of the process units 1Y, 1M, 1C, and 1K includes a corresponding one of the photosensitive elements 3Y, 3M, 3C, and 3K as image carriers and a corresponding one of developing units 40Y, 40M, 40C, and 40K arranged to correspond to the photosensitive elements 3Y, 3M, 3C, and 3K. Each of the photosensitive elements 3Y, 3M, 3C, and 3K is formed by, although not limited, coating an aluminum bare tube with organic photosensitive layer, and is driven to rotate in a clockwise direction in FIG. 1 at a predetermined linear velocity by a driving unit (not shown). The laser light L emitted from the optical write unit 50 is modulated based on the image data that has been transmitted from a personal computer (PC) (not shown) or the like, with which the surfaces of the photosensitive elements 3Y, 3C, 3M, and 3K are scanned in darkness to form yellow, magenta, cyan, and black latent images thereon.

Figure 2:
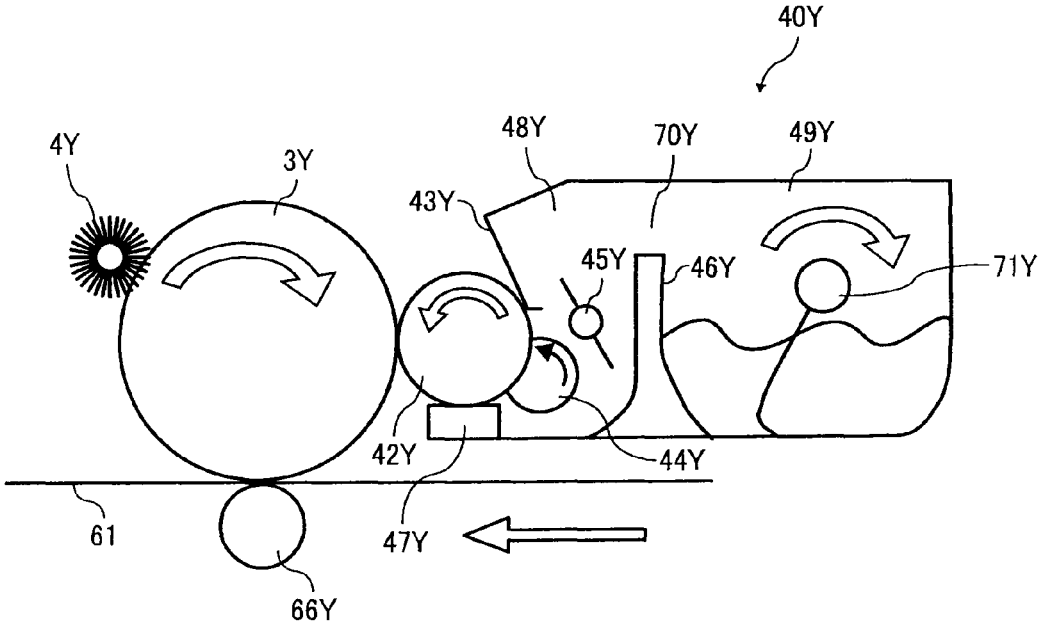
FIG. 2 is an enlarged view of a process unit shown in FIG. 1.

FIG. 2 is a schematic diagram of the process unit 1Y. The process unit 1Y includes the photosensitive element 3Y, a charging brush roller 4Y, a neutralizing lamp (not shown), and the developing unit 40Y, all of which are held in a casing to be a single process cartridge that is detachable from the image forming apparatus 10.

The photosensitive element 3Y has a diameter of about 24 millimeters and is formed by coating a conductive aluminum bare tube with photosensitive layer made of negatively chargeable organic photoconductor (OPC). The photosensitive element 3Y functions as a charging target and an image carrier, and is driven to rotate in a clockwise direction as indicated by an arrow in FIG. 2 at a predetermined linear velocity by a driving unit (not shown).

The charging brush roller 4Y is driven to rotate in a counterclock direction in FIG. 2 by a driving unit (not shown), so that the tips of a plurality of implanted fibers of the charging brush roller 4Y are slidingly in contact with the photosensitive element 3Y. The fibers of the charging brush roller 4Y are conductive and cut into a predetermined length. Resin materials such as, although not limited, nylon 6 (trademark), nylon 12 (trademark), acrylic, vinylon, polyester can be used as a material of the fibers to which carbon or metal powder is dispersed to have conductivity. From the aspect of the manufacturing cost and low Young's modulus of the material, the conductive fiber of carbon-dispersed nylon resin is preferable. The carbon can be unevenly dispersed in the nylon fiber.

The charging brush roller 4Y is connected to a charge bias power supply unit (not shown) that includes a power supply and wiring, whereby a charge bias voltage generated by superimposing an alternating current (AC) voltage on a direct current (DC) voltage is applied to the charging brush roller 4Y. The image forming apparatus 10 is configured to include a charging unit (not shown) that includes the charging brush roller 4Y, the driving unit that rotates the charging brush roller 4Y, and the bias power supply unit. The charging unit uniformly charges the surface of the photosensitive element 3Y to, for example, a negative polarity by generating a discharge between the fibers of the charging brush roller 4Y and the photosensitive element 3Y. The charging brush roller 4Y is arranged in the process unit 1K together with the photosensitive element 3Y and the like to be detachable from the image forming apparatus 10.

The uniformly charged surface of the photosensitive element 3Y is scanned by the laser light L emitted from the optical write unit 50 to form a latent image thereon. The latent image is then developed into a yellow toner image by the developing unit 40Y.

The developing unit 40Y employs a contact developing method and a nonmagnetic one-component developer composed of a nonmagnetic toner. The developing unit 40Y includes a developing roller 42Y, a regulating unit 43Y, a supply roller 44Y, and an agitating member 45Y in a developing chamber 48Y, an agitating member 71Y in a supply chamber 49Y, and a partition 46Y that divides the developing chamber 48Y and the supply chamber 49Y. The developing roller 42Y functions as a developer carrier, the supply roller 44Y picks-up toner from the developing chamber 48Y and supplies the toner onto the developing roller 42Y, the regulating unit 43Y regulates the thickness of the developer on the developing roller 42Y, and the agitating member 45Y agitates the toner in the developing chamber 48Y. Because the partition 46Y is higher than the positions at which the supply roller 44Y and the agitating member 45Y are arranged, the toner in the developing chamber 48Y does not reversely flow into the supply chamber 49Y.

The agitating member 71Y rotates in a clockwise direction as indicated by an arrow in FIG. 2 to agitate the toner in the developing chamber 48Y. Moreover, as the agitating member 71Y rotates, the toner in the developing chamber 48Y is passed to the developing chamber 48Y through an opening aperture 70Y arranged above the partition 46Y. Furthermore, as the agitating member 71Y agitates the toner in the developing chamber 48Y, the toner in the developing chamber 48Y is electrostatically charged due to friction.

The supply roller 44Y contacts with the developing roller 42Y with a nip width of 0.5 millimeters. The supply roller 44Y rotates in a direction same as or opposite to the rotation of the developing roller 42Y to supply the toner adhered to the supply roller 44Y to the developing roller 42Y. The surface of the supply roller 44Y is coated with a porous foam material to effectively absorb the toner in the developing chamber 48Y and prevent damage to the toner due to stress concentration at a contact portion in which the supply roller 44Y is in contact with the developing roller 42Y. An offset voltage of about −100 volts to the potential of the developing roller 42Y that is the same polarity as that of the toner is applied to the supply roller 44Y as a supply bias voltage. The supply bias voltage acts in a direction in which the pre-charged toner is pressed against the developing roller 42Y at the contact portion. The polarity of the voltage applied to the supply roller 44Y is not limited to the above polarity. The voltage applied to the supply roller 44Y can have the potential same as that of the developing roller 42Y or the polarity of the supply roller 44Y can be reversed from the above case depending on the type of the developers.

The developing roller 42Y is formed by the following manner. A metal core is covered with a 3-millimeter-thick elastic layer made of silicon rubber or the like, which is further coated with a coating layer made of material that is charged easily to a polarity opposite to that of the developer. The elastic layer has a JIS-A hardness of equal to or lower than 50 degrees, so that the contact state between the developing roller 42Y and the photosensitive element 3Y is kept constant. Furthermore, an electrical resistivity in the range of $10^3$ Ω/cm to $10^{10}$ Ω/cm is desirable to cause a developing bias voltage to act, and a surface roughness Ra in the range of 0.2 micrometers to 2.9 micrometers is desirable to sustain the necessary amount of the developer. The developing roller 42Y rotates in the counterclock direction to convey the developer carried on the surface thereof to a position opposing the photosensitive element 3Y through the regulating unit 43Y. The developing roller 42Y is in a contact with the photosensitive element 3Y.

The regulating unit 43Y is of a sheet metal spring made of, for example, SUS304CSP, SUS301CSP, and phosphor bronze. The free end of the regulating unit 43Y is in pressure-contact with the surface of the developing roller 42Y by a pressing force of 10 N/m to 100 N/m. The developer that has passed though the regulating unit 43Y under the pressing force has a reduced thickness, and is friction charged. To enhance the friction charging, a voltage having a polarity same as that of the developer with respect to the potential of the developing roller 42Y can be applied to the regulating unit 43Y as a regulating bias.

In the developing unit 40Y, the photosensitive element 3Y rotates in the clockwise direction, and the surface of the developing roller 42Y moves in a direction same as the direction in which the photosensitive element 3Y rotates at the position opposing the photosensitive element 3Y. Moreover, the desirably thin developer on the developing roller 42Y is conveyed to the position opposing the photosensitive element 3Y by the rotation of the developing roller 42Y. Then, the toner moves onto the surface of the photosensitive element 3Y by the bias voltage applied to the developing roller 42Y and a latent image electrical field generated by a latent image on the photosensitive element 3Y, so that the latent image is developed.

Residual toner remaining on the developing roller 42Y is collected into the developing chamber 48Y. The residual toner that has passed through a nip between the conductive sheet 47Y and the developing roller 42Y can be friction charged with a conductive sheet 47Y, which is a neutralizing member and provided at a position at which the residual toner is collected into the developing chamber 48Y to be in contact with the developing roller 42Y. As a result, the residual toner is neutralized, so that electrostatic attraction force acting between the developing roller 42Y and the residual toner is released. Therefore, the residual toner on the developing roller 42Y can be collected into the developing chamber 48Y. As the materials for the conductive sheet 47Y, for example, although not limited, nylon, Polytetrafluoroethylene (PTFE), Polyvinylidene Fluoride (PVDF), urethane, and polyethylene can be used. Furthermore, the conductive sheet 47Y has a thickness of, although not limited, 0.1 millimeters and a surface resistivity of, although not limited, $10^5$ Ω/□. The conductive sheet 47Y can be provided with a bias applying unit to apply a voltage with a polarity opposite to that of the toner.

The yellow toner image on the photosensitive element 3Y is transferred onto an intermediate transfer belt 61 at a primary transfer nip for yellow at which the photosensitive element 3Y is in contact with the intermediate transfer belt 61. After the transfer of the yellow toner image, some yellow toner remains on the surface of the photosensitive element 3Y.

No dedicated cleaning unit is provided to clean the residual toner from the photosensitive element 3Y. Specifically, the dedicated cleaning unit means a mechanism that separates the residual toner from the image carrier and thereafter collects the residual toner into a toner waste container or a developer unit to be reused.

The cleaner-less method roughly falls into three types of a scraping method, a temporary capturing method, and a scraping plus temporary capturing method. The scraping method employs a scraping member such as a brush. The brush is slidingly in contact with a latent image carrier to weaken adhesion force of the residual toner on the latent image carrier after the transfer process by scraping the residual toner. The residual toner is then electrostatically transferred onto a developing member such a developing roller and a developing sleeve before or at a developing area where the developing member is arranged opposed to the image carrier, and finally the residual toner is conveyed from the developing member to a developing unit and collected into the developing unit. The residual toner on the image carrier passes through an optical writing position for forming a latent image before being collected. However, if the amount of the residual toner is relatively small, the residual toner does not adversely affect the latent image writing. If toner charged to a polarity opposite to the normal polarity of the residual toner is contained in the residual toner, that toner is not transferred to the developing member, resulting in toner stain on the surface of the latent image carrier. To prevent the toner stain, it is desirable to provide a toner charging unit that charges the residual toner on the latent image carrier to the normal polarity between the transfer position (for example, a first transfer nip) and the scraping position by the scraping member, or between the scraping position and the developing area. As the scraping member, a fixed brush formed by attaching a plurality of conductive fibers to a sheet metal or a unit casing, a brush roller formed by implanting a plurality of fibers in a metallic rotary shaft, and a roller member having a roller portion made of a conductive sponge or the like can be used. Out of the above scraping members, the fixed brush can be made of relatively fewer fibers compared with the other members, so that the cost is low. However, in view of an additional function as a charging member to uniformly charge the latent image carrier, sufficient uniform charging can not be attained by the fixed brush. By contrast, sufficient charging uniformity can be attained by the brush roller, which therefore is desirably used.

The temporary capturing method employs a capturing member such as a rotary brush that rotates endlessly while being in contact with the surface of a latent image carrier to temporarily capture a post-transfer residual toner on the latent image carrier. The residual toner adhered to the capturing member is transferred back to the latent image carrier after a printing is completed or between printings (at an interval of feeding sheets). Thereafter, the residual toner is electrostatically transferred to a developing member such as a developing roller to be collected into a developing unit. In the scraping method, when a solid image is formed or after a sheet jam occurs, an amount of the residual toner increases, the quality of an image may be degraded because the amount of the residual toner exceeds the capacity of the developing member. However, in the temporary capturing method, because the residual toner captured by the capturing member is gradually collected into the developing member, the degradation of an image can be prevented.

In the scraping plus temporary capturing method, a rotary brush or the like that comes in contact with a latent image carrier is used to function as the scraping member as well as the capturing member. Specifically, the rotary brush can function as the scraping member by applying only DC voltage to the rotary brush, and can function as the capturing member by switching from the DC voltage to AC voltage on which DC voltage is superimposed as necessary. AC voltage can be applied to the rotary brush to function as the scraping member supply bias voltage or the capturing member.

The process units 1Y, 1M, 1C, and 1K employ the temporary capturing cleaner-less method. Specifically, the photosensitive element 3Y is in contact with the surface of the intermediate transfer belt 61 to form a first transfer nip for yellow while being driven to rotate in the clockwise direction in FIG. 2 at a predetermined linear velocity of about 124 mm/sec. The surface of the photosensitive element 3Y is uniformly charged to −500 volts by a discharge generated between the charging brush roller 4Y and the photosensitive element 3Y. At the same time, the residual toner on the photosensitive element 3Y is temporarily captured onto the fibers of the charging brush roller 4Y by synergy effect of the charging bias of the charging brush roller 4Y, the physical contact with the charging brush roller 4Y, and scraping by the charging brush roller 4Y. Then, the charging bias voltage is switched to the value that facilitates transferring the toner captured on the charging brush roller 4Y back onto the photosensitive element 3Y after a printing is completed or at an interval of feeding sheets. The toner transferred onto the photosensitive element 3Y is collected into the developing unit 40Y through the developing roller 42Y.

The other process units 1M, 1C, and 1K have the same configuration as that of the process unit 1Y, so that an explanation thereof is omitted.

As shown in FIG. 1, the transfer unit 60 is arranged under the process units 1Y, 1M, 1C, and 1K. The intermediate transfer belt 61 is supported by the transfer unit 60 and support rollers such as a driven roller 62, a drive roller 63, and four primary transfer bias rollers 66Y, 66M, 66C, and 66K. The intermediate transfer belt 61 rotates in the counterclock direction in FIG. 1 endlessly.

The driven roller 62, the drive roller 63, and the primary transfer bias rollers 66Y, 66M, 66C, and 66K are all in contact with the inner surface of the intermediate transfer belt 61. Each of the primary transfer bias rollers 66Y, 66M, 66C, and 66K is formed by covering a metal core with an elastic element such as a sponge, and is pressed against the corresponding one of the photosensitive elements 3Y, 3M, 3C, and 3K to sandwich the intermediate transfer belt 61. As a result, four first transfer nips are formed, in each of which the corresponding one of the photosensitive elements 3Y, 3M, 3C, and 3K is in contact with the intermediate transfer belt 61 over a predetermined length in the travel direction of the intermediate transfer belt 61.

A primary transfer bias voltage that is constant-current controlled by a transfer bias power source (not shown) is applied to each core of the primary transfer bias rollers 66Y, 66M, 66C, and 66K, whereby a transfer charge is applied to the inner side of the intermediate transfer belt 61 via the primary transfer bias rollers 66Y, 66M, 66C, and 66K. Therefore, a transfer electrical field is formed at each of the primary transfer nips between the photosensitive elements 3Y, 3M, 3C, and 3K and the intermediate transfer belt 61. Roller-shaped members are employed for the primary transfer means in the above embodiment, however, for example, a brush, a blade, or a transfer charger can be used.

Toner images of yellow, magenta, cyan, and black formed on the photosensitive elements 3Y, 3M, 3C, and 3K are transferred onto the intermediate transfer belt 61 in a superimposing manner at the primary transfer nips of respective colors, whereby a four-color toner image is formed onto the intermediate transfer belt 61.

A secondary transfer bias roller 67 is in contact with the outer surface of the intermediate transfer belt 61 at a portion where the intermediate transfer belt 61 is supported by the drive roller 63, so that a secondary transfer nip is formed. A secondary transfer bias voltage is applied to the secondary transfer bias roller 67 by a power supply unit (not shown) composed of a power source and wiring, so that a second transfer electrical field is formed at the second transfer nip between the secondary transfer bias roller 67 and the drive roller 63. The four-color toner image formed on the intermediate transfer belt 61 enters into the second transfer nip along with the traveling of the intermediate transfer belt 61.

The image forming apparatus 10 includes a feed tray (not shown) in which a plurality of sheets P as a recording medium is stacked. An uppermost sheet P in the feed tray is fed into the sheet feed path and is conveyed to a registration nip of the registration rollers 54 arranged in the most downstream side of the sheet feed path to be nipped at the registration nips.

Both of the registration rollers 54 are driven to rotate to nip the sheet P conveyed from the feed tray at the registration nip. Immediately after nipping the tip of the sheet P, the registration rollers 54 stop the rotation. Then, the registration rollers 54 starts to feed the sheet P toward the secondary transfer nip in synchronization with the four-color toner image on the intermediate transfer belt 61. At the secondary transfer nip, the four-color toner image on the intermediate transfer belt 61 is collectively secondary-transferred onto the sheet P by the action of the second transfer electrical field and a pressure by the secondary transfer nip, so that a full color image is formed in combination with the white color of the sheet P.

The full color image formed onto the sheet P is fed from the secondary transfer nip toward a fixing unit (not shown), whereby the full color image is fixed to the sheet.

The toner remaining on the surface of the intermediate transfer belt 61 after having passed through the secondary transfer nip is removed by a belt cleaning unit 68.

Although toner remains on the surfaces of the photosensitive elements 3Y, 3M, 3C, and 3K after having passed the first primary transfer nips, a cleaning unit that cleans the residual toner is not provided in any of the process units 1Y, 1M, 1C, and 1K because the image forming apparatus 10 employs the cleaner-less method for collecting the residual toner on the photosensitive elements 3Y, 3M, 3C, and 3K into the developing rollers 42Y, 42M, 42C, and 42K.

In the image forming apparatus 10, each of the photosensitive elements 3Y, 3M, 3C, and 3K functions as a rotatable image carrier that carries a latent image onto the surface thereof. Furthermore, the optical write unit 50 functions as a latent image forming unit that forms latent images onto the uniformly charged surfaces of the photosensitive elements 3Y, 3M, 3C, and 3K.

The inventors conducted some experiments. The inventors employed a test machine and a conventional image forming apparatus. The test machine is an image forming apparatus having substantially the same configuration as that of the image forming apparatus 10 shown in FIGS. 1 and 2 except that the process units are arranged in the color order of yellow, cyan, magenta, and black. The conventional image forming apparatus had developing units in each of which the supply chamber and the developer chamber are not divided. The test conditions were as follows. The linear velocity of a rotation of a photosensitive element was about 120 mm/s. A developing roller had a resistance of about 1E+0.7 ohm, and was formed by coating a metal core with a 3-millimeter-thick silicon rubber and further with a surface layer material. A cantilevered stainless used steel (SUS) plate with one end bent into an L shape was used for the regulating unit 43Y. The potential of the photosensitive element was −500 volts. The exposure potential Vr was −50 volts. The developing bias voltage Vb was −150 volts to −350 volts (variable depending on the toner density). The charging brush roller 4Y had a shaft diameter of 5 millimeters and an outer diameter of 11 millimeters, and nylon fibers were used for a material of the conductive fibers. The charging bias was a rectangular wave, and had a peak-to-peak voltage of 1.0 kilovolt, a duty cycle of 50%, and a frequency of 300 hertz during printing and 10 hertz when the bias is not applied (when cleaning the brush). The conductive sheet 47Y was removed.

Figure 3:
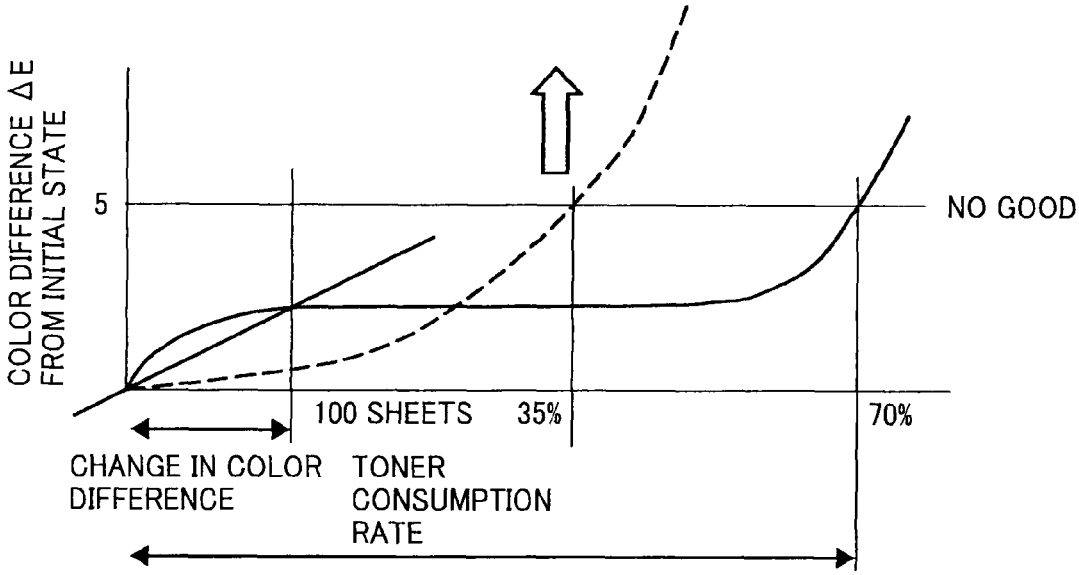
FIG. 3 is a graph illustrating change in color difference in the image forming apparatus according to the embodiment and a conventional image forming apparatus.

The experiments were conducted under the conditions of an ambient temperature of 27° C. and a relative humidity of 80% RH. Durable charts that contain text and solid images of four colors were concurrently printed successively, and the color difference ΔE between a single color of magenta and an initial image was verified. The color difference ΔE was measured with Macbeth densitometer (model: RD914). FIG. 3 is a graph representing the result of the experiments. The dotted line shows the results for the conventional image forming apparatus and the continuous line shows the results for the test machine. The amount of the toner consumption was calculated by subtracting the post-test weight of the developing unit from the initial weight of the developing unit. And then, the toner consumption rate was calculated based on the obtained toner consumption amount and the initial toner amount.

In the conventional image forming apparatus in which the supply chamber and developer chamber are not divided, toner (hereinafter, "reversely-transferred toner") that is reversely transferred from the photosensitive element was dispersed evenly into toner (hereinafter, "initial toner") that is initially contained in the developing unit. Therefore, the reversely-transferred toner was not consumed when the amount of toner in the developing unit was large at the initial phase of the toner use, so that the color difference ΔE was small as shown by the dotted line in FIG. 3. However, as the proportion of the reversely-transferred toner to the initial toner increased as the toner in the developing unit was consumed, the color difference ΔE sharply increased. As a result, the color difference ΔE between the initial image and an image formed at a relatively earlier printing phase reached a noticeable level. That is, the color difference ΔE exceeds five.

In the test machine with the partition 46Y between the developing chamber 48Y and the supply chamber 49Y, the reversely-transferred toner stayed in the developing chamber 48Y and was dispersed into a small amount of the initial toner supplied from the supply chamber 49Y to be actively consumed. Therefore, the color difference ΔE sharply increased at the initial phase. However, because of the supply of the initial toner not containing the reversely-transferred toner and the active consumption of the reversely-transferred toner, the proportion of the reversely-transferred toner in the developing chamber 48Y became stable. As a result, the stable color difference over time has been attained. In other words, the amount of the reversely-transferred toner that was consumed for one image forming was almost equal to the amount of the toner that was reversely transferred for one image forming. Therefore, as shown by the continuous line in FIG. 3, when the initial toner was constantly supplied from the supply chamber 49Y, there was no increase in the color difference, so that the stable color reproducibility has been obtained over time.

In spite of the sharp increase in the color difference at the initial phase, when 100 images were continuously printed, the color difference ΔE at the 100-th printing with respect to the first printing resulted in 0.9 that was lower than the color difference ΔE of 1, which was below the level that the human eye can recognize.

Another experiment was conducted under a different test condition. The conductive sheet 47Y made of PVDF was arranged in the test machine at a position on the downstream side in the developing area where the reversely-transferred toner returns into the developing chamber 48Y. The conductive sheet 47Y had a thickness of 0.1 millimeters and a surface resistivity of $10^5$ Ω/□.

The reversely-transferred toner that was released from the charging brush roller 4Y and adhered to the developing roller 42Y at a predetermined time (for example, at an interval of feeding sheets) was neutralized and surely collected into the developing chamber 48Y by providing the conductive sheet 47Y. As a result, it was possible to suppress adverse effect of the reversely-transferred toner partially remaining on the developing roller on the next image forming, so that the increase in the color difference has been prevented. The experiments resulted in that the color difference between the initial printing and the 100-th printing (hereinafter, "100-th printing color difference") was dropped to 0.7. Because the reversely-transferred toner was surely collected into the developing chamber 48Y, the toner consumption rate was raised to 75% when the color difference dropped to the color noticeable level.

Because charges were injected into the reversely-transferred toner to be collected into the developing chamber 48Y by applying voltage having a polarity opposite to that of the toner to the conductive sheet 47Y, the reversely-transferred toner adhered to the developing roller 42Y was surely neutralized and collected into the developing chamber 48Y. As a result, the 100-th printing color difference dropped to 0.6, and the toner consumption rate rose to 78% when the color difference dropped to the color noticeable level.

Furthermore, the nip width between the conductive sheet 47Y and the developing roller 42Y was set to 3 millimeters or wider, so that the friction charge time was increased, thereby enabling to surely neutralizing the reversely-transferred toner. As a result, the 100-th printing color difference was dropped to 0.6, and the toner consumption rate was raised to 76% when the color difference dropped to the color noticeable level.

Figure 4:
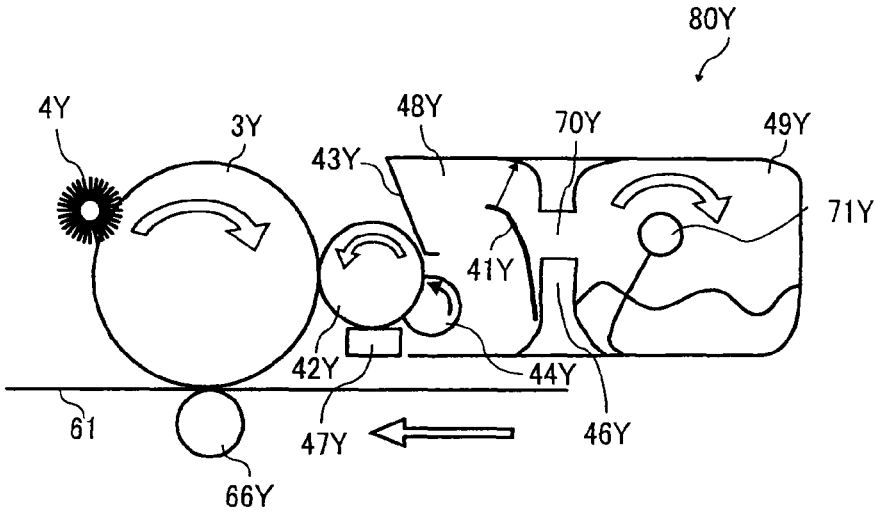
FIG. 4 is an enlarged view of a process unit according to another embodiment of the present invention.

A developing unit 80Y according to another embodiment of the present invention is shown in FIG. 4. This developing unit 80Y can be employed in the image forming apparatus 10 instead of the developing unit 40Y. In the developing unit 80Y, a check valve 41Y provided in the opening aperture 70Y to prevent the backflow of toner in the developing chamber 48Y into the supply chamber 49Y. The check valve 41Y is made of sheet-like elastic material such as rubber. One end of the check valve 41Y is fixed onto the wall of the partition 46Y on the side of the developing chamber 48Y and the other end is normally in contact with the upper wall of the developing chamber 48Y. When the toner in the supply chamber 49Y is supplied to the developing chamber 48Y through the opening aperture 70Y by the rotation of the agitating member 71Y, the check valve 41Y is elastically deformed toward the side of the developing chamber 48Y. As a result, the supply chamber 49Y and the developing chamber 48Y communicate, so that toner in the supply chamber 49Y is supplied to the developing chamber 48Y. On the contrary, when the toner in the developing chamber 48Y reversely flows toward the supply chamber 49Y, because the toner presses the check valve 41Y toward the supply chamber 49Y, the opening aperture 70Y is closed. Therefore, the backflow of the toner into the supply chamber 49Y has been prevented.

As mentioned above, in the developing unit 80Y, because of the presence of the check valve 41Y, the reversely-transferred toner stayed in the developing chamber 48Y in the same manner as the developing unit 40Y shown in FIG. 2. Furthermore, the toner not containing the reversely-transferred toner was supplied to the developing chamber 48Y, so that the proportion of the reversely-transferred toner in the developing chamber 48Y was made stable, thus enabling to obtain stable color difference over time. Therefore, while the toner is stably supplied from the supply chamber, the color difference does not increase, so that stable color reproducibility over time has been obtained. With the configuration including the check valve 41Y, the 100-th printing color difference ΔE was dropped to 0.1, and the toner consumption rate was raised to 81% when the color difference dropped to the color noticeable level.

In this manner, the inventors have arrived at the condition to sustain the color reproducibility over time as a result of the devoted researches described above. Their finding was that the color reproducibility is attainable by configuring an image forming apparatus such that the color difference ΔE of equal to or less than about five is ensured between a formed image and a unicolor image formed by toner not containing a toner of another color when the toner contained in a developing unit is consumed by about 70%. The color difference ΔE of five is the value that human eyes can start to recognize the color difference.

According to one aspect of the present invention, the color difference ΔE between a formed image and an initial image does not exceed five, so that image forming with high color reproducibility for a prolonged time has been attained.

Furthermore, according to another aspect of the present invention, the color difference between a formed image after images have been continuously formed and an initial image, can be made less than the color difference non-noticeable level.

Moreover, according to still another aspect of the present invention, the proportion of a reversely-transferred toner in a developing chamber has been made stable, so that a stable color difference over time has been attained. As a result a color difference ΔE is made not exceeding five with respect to an initial image formed by using a toner not containing a reversely-transferred toner of another color until the toner contained in a toner container is consumed by about 70%.

Furthermore, according to still another aspect of the present invention, backflow of a toner in a developing chamber into a supply chamber has been prevented.

Furthermore, according to still another aspect of the present invention, continuous adhering of a reversely-transferred toner to a developing roller that adversely affects next image forming can be prevented.

Furthermore, according to still another aspect of the present invention, a reversely-transferred toner has been surely neutralized.

Furthermore, according to still another aspect of the present invention, replacements of photosensitive elements and developing units can be easily performed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a plurality of image carriers, each of which carries a unicolor image of a corresponding color; and a plurality of developing units corresponding to each of the image carriers, each of the developing units including a toner container that contains a first toner, the toner container including a developing chamber that houses a mixture of the first toner and a second toner, a supply chamber that houses the first toner, and a backflow prevention member that prevents flow of the mixture from the developing chamber into the supply chamber, a toner carrier, disposed in the developing chamber, that picks the first toner from the toner container and carries the first toner to a corresponding image carrier thereby developing a latent image on the corresponding image carrier with the first toner into a unicolor toner image, and the toner carrier collects the second toner, which remains on the corresponding image carriers, into the developing unit after the toner image has been transferred from the corresponding image carrier onto a transfer target member, and a regulating member configured to regulate a thickness of the first toner on the toner carrier, wherein the supply chamber is arranged laterally adjacent to the developing chamber, and wherein the backflow prevention member is disposed so as to divide the supply chamber and the developing chamber and has a height higher than positions at which the toner carrier and the regulating member are in contact.

2. The image forming apparatus according to claim 1, wherein the developing unit is configured such that a color difference, between a third image and a fourth image formed on respective transfer target members, is equal to or less than about one, the third image being a 1-st image formed by using the developing unit while use of the developing unit began, and the fourth image being a 100-th image formed by using the developing unit.

3. The image forming apparatus according to claim 1, wherein the toner container further includes a toner supply member that supplies the mixture onto the toner carrier, and an agitating member that agitates the mixture in the developing chamber, wherein the backflow prevention member has a first portion that adjoins a base of the toner container, and a second portion opposite the first portion that extends vertically to a height higher than vertical positions at which the toner supply member and the agitating member are arranged laterally with respect to the backflow prevention member.

4. The image forming apparatus according to claim 3, wherein the toner container includes a check valve that prevents flow of the mixture from the developing chamber into the supply chamber, the check valve being arranged in a communication passage that connects the developing chamber and the supply chamber.

5. The image forming apparatus according to claim 3, further comprising a neutralizing unit that neutralizes toner adhered to the toner carrier and is arranged on a downstream side of an area in which the toner carrier and the image carrier oppose each other in a rotation direction of the toner carrier.

6. The image forming apparatus according to claim 5, wherein the neutralizing unit includes a conductive member that is in contact with the toner carrier; and a bias applying unit that applies a bias voltage to the conductive member.

7. The image forming apparatus according to claim 5, wherein the neutralizing unit includes a conductive member that is in contact with the toner carrier, and a nip width between the conductive member and the toner carrier is equal to or greater than 3 millimeters.

8. A developing unit for use in an image forming apparatus, the image forming apparatus including an image carrier, the developing unit comprising:

a toner container that contains a first toner, the toner container including a developing chamber that houses a mixture of the first toner and a second toner, a supply chamber that houses the first toner, and a backflow prevention member that prevents flow of the mixture from the developing chamber into the supply chamber;

a toner carrier, disposed in the developing chamber, that picks the first toner from the toner container and carries the first toner to the image carrier thereby developing a latent image on the image carrier with the first toner into a unicolor toner image, and the toner carrier collects the second toner, which remains on the image carriers, into the developing unit after the toner image has been transferred from the image carrier onto a transfer target member; and a regulating member configured to regulate a thickness of the first toner on the toner carrier, wherein the supply chamber is arranged laterally adjacent to the developing chamber, and wherein the backflow prevention member divides the supply chamber and the developing chamber and has a height higher than positions at which the toner carrier and the regulating member are in contact.

9. An image forming method implemented on an image forming apparatus that includes a plurality of image carriers each of which carries a unicolor image of a corresponding color, and a plurality of developing units corresponding to each of the image carriers, each of the developing units including a toner container that contains a first toner, and a toner carrier that picks the first toner from the toner container and carries the first toner to a corresponding image carrier thereby developing a latent image on the corresponding image carrier with the first toner into a unicolor toner image, and the toner carrier collects a toner developer, which remains on the corresponding image carriers, into the developing unit after the toner image has been transferred from the corresponding image carrier onto a transfer target member, the image forming method comprising:

configuring the developing unit such that the developing unit includes a regulating member configured to regulate a thickness of the first toner on the toner carrier;

configuring the toner container such that the toner container includes a developing chamber that houses a mixture of the first toner and the second toner, a supply chamber that houses the first toner, a backflow prevention member that prevents flow of the mixture from the developing chamber into the supply chamber;

arranging the supply chamber laterally adjacent to the developing chamber; and arranging the backflow prevention member to divide the supply chamber and the developing chamber, the backflow prevention member having a height higher than positions at which the toner carrier and the regulating member are in contact.

10. The image forming method according to claim 9, wherein the configuring the developing unit includes configuring the developing unit such that a color difference, between a third image and a fourth image formed on respective transfer target members, is equal to or less than about one, the third image being a 1-st image formed by using the developing unit while use of the developing unit began, and the fourth image being a 100-th image formed by using the developing unit.

11. The image forming method according to claim 9, wherein the configuring the toner container further includes configuring the toner container such that the toner container further includes a toner supply member that supplies the mixture onto the toner carrier, and an agitating member that agitates the mixture in the developing chamber, and wherein the arranging the backflow prevention member includes arranging the backflow prevention member such that a first portion thereof adjoins a base of the toner container, and such that a second portion thereof, opposite the first portion, extends vertically to a height higher than vertical positions at which the toner supply member and the agitating member are arranged laterally with respect to the backflow prevention member.

12. The image forming method according to claim 11, wherein the toner container includes a check valve that prevents flow of the mixture from the developing chamber into the supply chamber, the check valve being arranged in a communication passage that connects the developing chamber and the supply chamber.

13. The image forming method according to claim 11, further comprising neutralizing toner adhered to the toner carrier with a neutralizing unit at a position downstream side of an area in which the toner carrier and the image carrier oppose each other in a rotation direction of the toner carrier.

14. The image forming method according to claim 13, wherein the neutralizing unit includes a conductive member that is in contact with the toner carrier; and a bias applying unit that applies a bias voltage to the conductive member.

15. The image forming method according to claim 13, wherein the neutralizing unit includes a conductive member that is in contact with the toner carrier, and a nip width between the conductive member and the toner carrier is equal to or greater than 3millimeters.

16. The image forming apparatus according to claim 1, wherein the developing unit is configured to develop images such that a color difference, between a first image and a second image formed on respective transfer target members, is equal to or less than about five, the first image being an image formed with the first toner not containing any other toner, and the second image being an image formed with the mixture of the first toner and the second toner while the first toner contained in the toner container is consumed by about 70%.

17. The developing unit according to claim 8, wherein the developing unit is configured to develop images such that a color difference, between a first image and a second image formed on respective transfer target members, is equal to or less than about five, the first image being an image formed with the first toner not containing any other toner, and the second image being an image formed with the mixture of the first toner and the second toner while the first toner contained in the toner container is consumed by about 70%.

18. The image forming method according to claim 9, wherein the configuring the developing unit further includes configuring the developing unit to develop images such that a color difference, between a first image and a second image formed on respective transfer target members, is equal to or less than about five, the first image being an image formed with the first toner not containing any other toner, and the second image being an image formed with the mixture of the first toner and the second toner while the first toner contained in the toner container is consumed by about 70%.

* * * * *